US006608993B1

(12) United States Patent
Ficco

(10) Patent No.: US 6,608,993 B1
(45) Date of Patent: Aug. 19, 2003

(54) VEHICULAR AUDIO DATA FILE HANDLING APPARATUS SYSTEM AND METHOD

(75) Inventor: Michael Ficco, Silver Spring, MD (US)

(73) Assignee: Hughes Electronics Corporation, El Segundo, CA (US)

( * ) Notice: Subject to any disclaimer, the term of this patent is extended or adjusted under 35 U.S.C. 154(b) by 485 days.

(21) Appl. No.: 09/598,749

(22) Filed: Jun. 21, 2000

(51) Int. Cl.[7] ..... H04H 7/00

(52) U.S. Cl. ..... 455/3.06; 455/414.3; 455/557; 455/345; 725/92

(58) Field of Search ..... 455/3.05, 3.06, 455/403, 414, 412, 418, 419, 466, 550, 561, 66, 556, 557, 45, 186.1, 344, 345, 346, 414.3; 369/6, 7; 725/92

(56) References Cited

U.S. PATENT DOCUMENTS 5,671,195 A * 9/1997 Lee ..... 369/7
5,694,455 A * 12/1997 Goodman ..... 455/413
5,742,893 A * 4/1998 Frank ..... 455/66
5,790,935 A * 8/1998 Payton ..... 725/91
5,884,160 A * 3/1999 Kanazaki ..... 455/413
5,991,306 A * 11/1999 Burns et al. ..... 370/429
6,192,340 B1 * 2/2001 Abecassis ..... 704/270

* cited by examiner

*Primary Examiner*—Lee Nguyen
*Assistant Examiner*—Ronald J. Ward
(74) *Attorney, Agent, or Firm*—John T. Whelan; Michael Sales

(57) ABSTRACT

An audio data file-handling device which may receive one or more audio data files from a base station. This file transfer may be accomplished utilizing wireless transmissions. Furthermore, the base station may accumulate one or more audio data files from a variety of content sources and communication paths. An audio data file distribution system which accumulates audio data files in a base station and uploads at least one accumulated audio data file to an audio data file handling device. A user interface, such as a wireless control unit, may send a trigger signal to the base station either directly or via the audio data file-handling device. This triggering signal triggers the upload of audio data files from the base station to the audio data file-handling device. The triggering signal may also be generated upon a vehicle start condition or upon the arrival of a designated time. Furthermore, cellular or other wireless networks may be utilized to transfer audio data files over long distances.

3 Claims, 9 Drawing Sheets

VEHICULAR AUDIO DATA FILE HANDLING APPARATUS SYSTEM AND METHOD

BACKGROUND OF THE INVENTION

1. Field of the Invention

This invention generally relates to portable audio data file handling devices, distribution systems, as well as methods of transferring audio data files to a portable device. This invention also relates to vehicular audio data file handling devices, distribution systems and audio data file transfer methods.

2. Description of Related Art

Conventional automotive stereo components typically utilize a dash-mounted control unit and a remotely-mounted CD changer. For example, the remotely-mounted CD changer is typically mounted in the trunk of an automobile. Such products force the consumer to open the trunk, remove old CD's and insert new ones before starting the vehicle and otherwise enjoying the car stereo system. Also, the CD's in the automobile are not available on the home stereo equipment. Furthermore, the CD's in the automobile are subjected to extreme temperature fluctuations which can warp the CD.

Portable MP3 players followed the popularization of trunk-mounted CD changers. Various companies market MP3 players (e.g. the Diamond Rio™ Player). Conventional MP3 players generally include a storage device and decoder to decode the MP3 (MPEG layer 3) encoded audio data files.

Such MP3 players have also been adapted for use in a vehicle. For example, the EMPEG Car player (available at www.empeg.com) is a portable MP3 player which includes a hard disc drive that stores MP3 files. To transfer the files from a home computer to the EMPEG Car player, a user must physically connect the EMPEG Car player to the home computer with a cable. After transferring the MP3 file via the hard wired connection, the user then carries the EMPEG player to the car, slides it into the dash, and is then able to play back selected MP3 files.

Conventional MP3 players intended for an automobile, such as the EMPEG Car player, require a user to physically connect the player to a home computer with a cable. Such hard wired connections and the physical transporting of the player between the home computer and the automobile is inefficient, cumbersome, and objectionable to many consumers.

SUMMARY OF THE INVENTION

The present invention solves the above-identified problems in conventional MP3 players and provides a unique system and method for transferring audio data files. The invention also provides for a unique vehicular audio data file handling apparatus.

More specifically, the inventive system routes audio data content from one or more of a variety of sources to an audio data file accumulator. This audio data file accumulator accumulates a library of audio data files which can be distributed to the inventive vehicular audio data file handling apparatus using conventional methods as well as inventive methods disclosed herein. For example, instead of using a hard wired physical connection between the vehicular audio data file handling apparatus and the audio data file accumulator, the invention may use wireless transmissions to transfer the audio data files from the accumulator to the vehicular audio data file handling apparatus. Thus, a base station according to the invention includes not only an audio data file accumulator, but also a wireless transmitter.

The vehicular audio data file-handling apparatus includes a wireless receiver that receives audio data files wirelessly transmitted from the accumulator in the base station. The received files are stored in a memory and decoded/decrypted, as appropriate, when the user selects a particular audio data file(s) to be played back.

The invention may also utilize a wireless user interface that can send conventional commands such as play, skip, fast forward, etc. to the vehicular audio data file handling apparatus. The wireless user interface may also send a triggering signal either directly to the base station or to the base station via the audio data filing handling apparatus. This wireless triggering signal triggers the accumulator to upload one or more audio data files to the vehicular audio data file handling apparatus. In this way, the consumer can command the system to deliver audio data files from the base station to the vehicle without having to physically remove the player from the dash and without having to physically connect the player to the home computer or base station.

The invention may also use a vehicle start condition to trigger wireless audio data file transfer. To enable this alternative, an engine start detector is provided that detects when the vehicle engine has started. This start condition is utilized to trigger the audio data file accumulator to upload at least one audio data file to the vehicular audio data file handling apparatus. This provides a convenient method of audio data file transfer such that every time the user starts his vehicle, the player is provided with a fresh batch of audio data files.

The invention may also utilize a cellular phone network in order to transfer audio data files over long distances. Most wireless devices have a limited range. For example, infrared transmitters generally require a direct line of sight and a reasonable distance in order to achieve effective data transfer. However, cellular phone networks can transfer data over large distances. The invention utilizes such cellular phone networks to advantage by employing such networks to transfer audio data files from the base station to the vehicular audio data file handling apparatus.

Another method of transferring audio data files may be utilized in which a designated time serves a trigger condition. In other words, when a designated time arrives the system automatically transfers audio data files from the base station to the vehicular audio data file handling apparatus. For example, the designated time may be 3:00 a.m. when the vehicle in which the player is installed is typically in a garage or otherwise near the base station. In this way, audio data files can be conveniently wirelessly transmitted at a designated time thereby freeing the user from the cumbersome, conventional method of transferring audio data files to an automotive player.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not imitative of the present invention, and wherein.

DETAILED DESCRIPTION OF THE PREFERRED EMBODIMENTS

Figure 1:
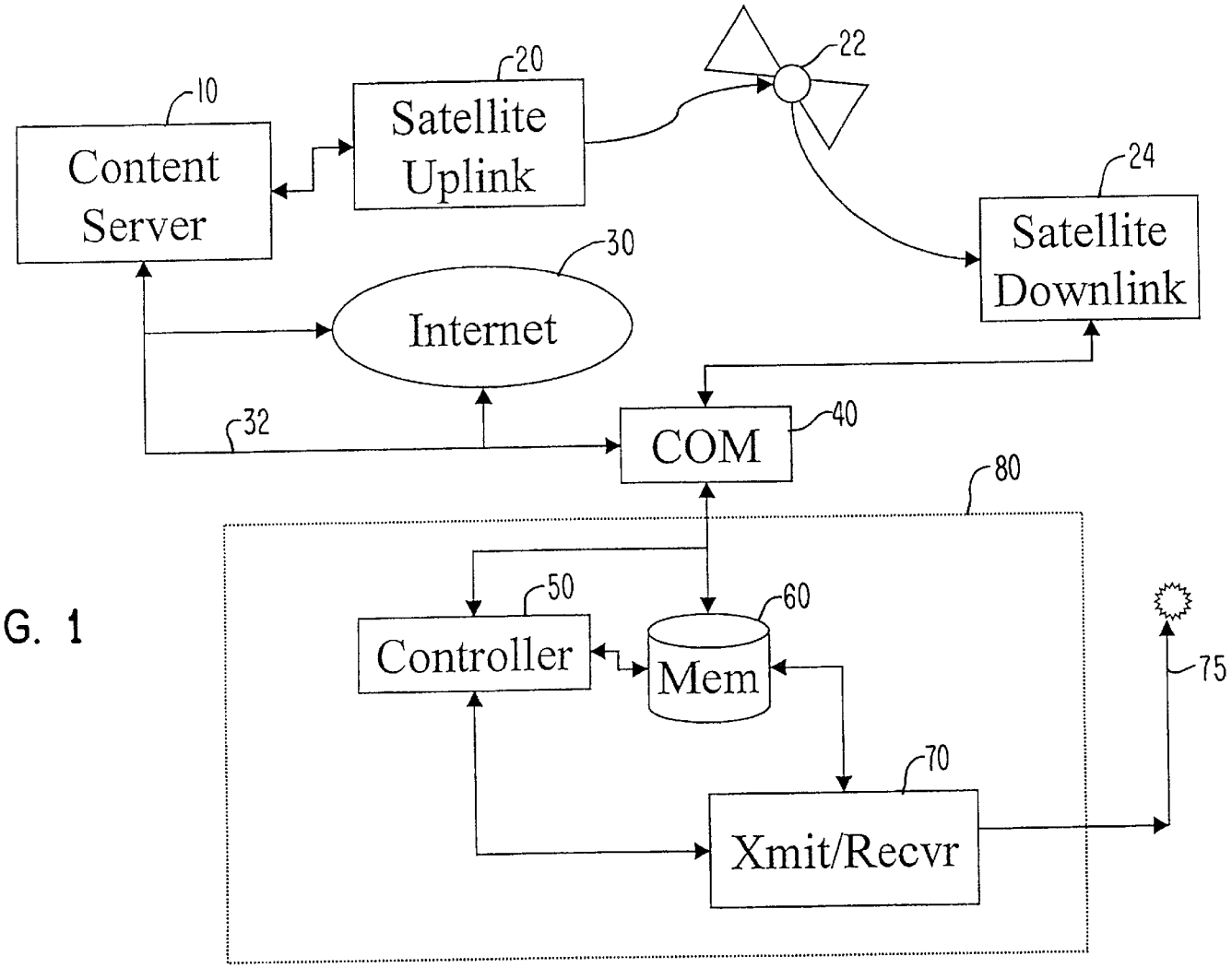
FIG. 1 is a diagram illustrating base station and content distribution system according to the invention.

FIG. 1 illustrates a system for transferring audio data files to a vehicular data file handling apparatus. On the front end, content is provided to a base station 80 via a variety of communication paths. Specifically, the content server 10 is connected to a satellite up-link 20 as well as the internet 30 and/or another communication line 32 which may be, for example, a telephone line (e.g. landline, cell phone network, wireless phone network, etc.). A communications device 40 (COM) provides an interface between these various communication paths and the base station 80.

The COM 40 may be constructed with conventional hardware and may include, for example, a MODEM for interfacing with communication line 32 the Internet and/or communication path 32 30. As an alternative, a satellite communication path is provided which includes satellite up-link 20, satellite 22, and satellite downlink 24 which connects to COM 40.

The base station 80 may be constructed as shown in FIG. 1 with a controller 50 connected to a memory 60 and transmitter/receiver 70. The transmitter/receiver 70 is connected to an antenna 75. Thus, as shown in FIG. 1, the transmitter/receiver 70 may be a wireless transmitter/receiver.

The system of FIG. 1 accumulates content as follows:

The content server 10 supplies one or more audio data files to the base station 80 via one or more of the communication paths (20→22→24; 30; or 32) described above. The COM 40 receives the audio data file(s) and transmits the received file to base station 80. The controller 50 in base station 80 accumulates the received audio data files in the memory device 60. The memory device 60 may utilize a hard disk drive, RAM, recordable CD, flash card, memory stick, etc. In other words, the memory device 60 accumulates audio data files.

As further described below, the audio data files accumulated in the memory 60 may be transmitted via a wireless transmission protocol by using the transmitter/receiver 70 and antenna 75 which operate under control of the controller 50.

Figure 2:
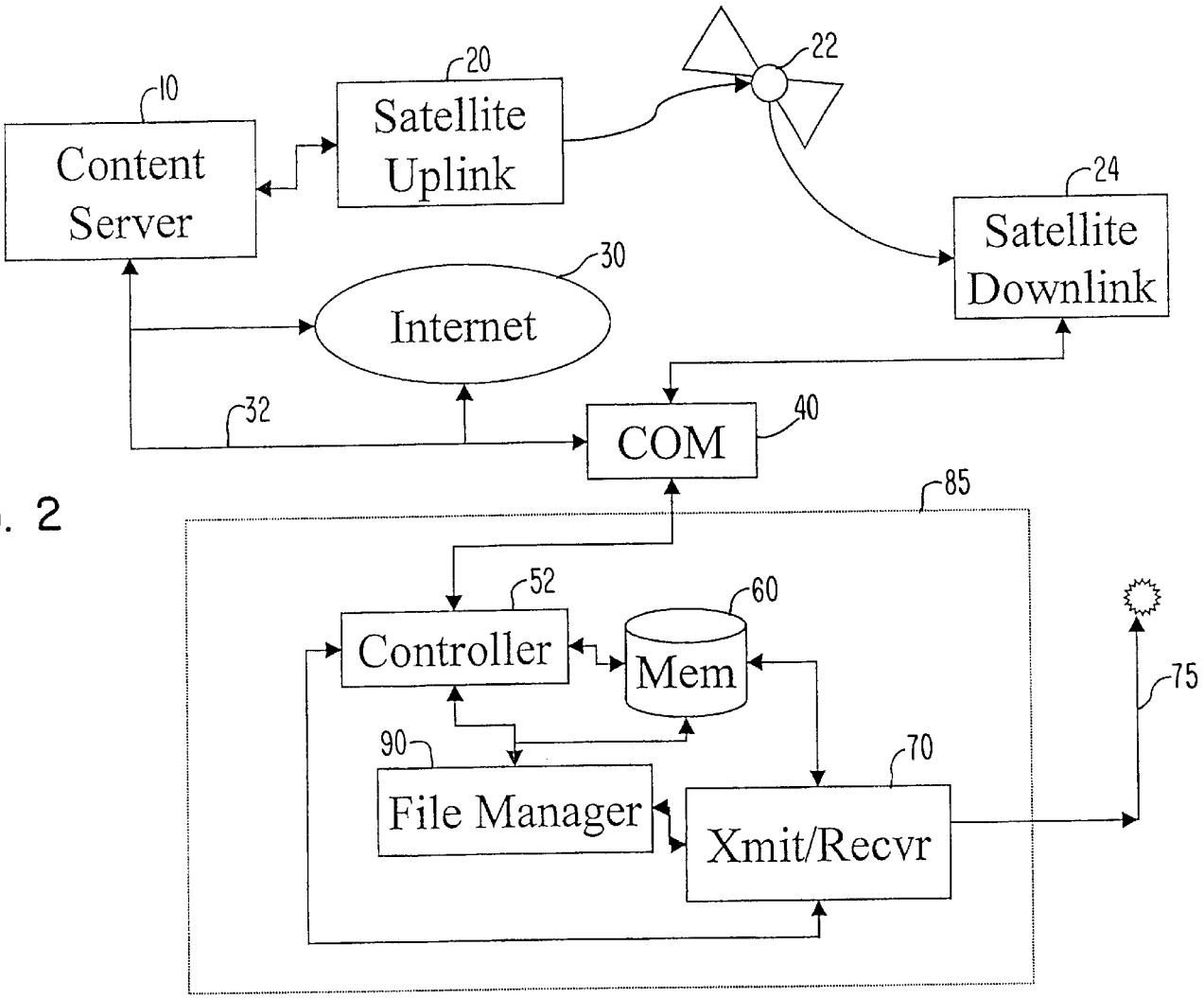
FIG. 2 illustrates an alternative, base station and a content distribution system according to the invention.

FIG. 2 shows an alternative construction of a base station and content distribution system of the present invention. The system of FIG. 2 contains many of the same components as shown in FIG. 1. The differences are noted here. The main difference is the addition of a file manager 90 which is connected to the controller 52, memory 60, and transmitter/receiver 70. File manager 90 implements conventional file managing functions such as organizing, editing, deleting, commenting, etc. The file manager 90 is particularly useful when there is a collection of audio data files accumulated in the memory 60. The controller 52 controls the file manager 90 as well as the memory 60 and transmitter/receiver 70. The resulting apparatus is a base station 85.

Figure 3:
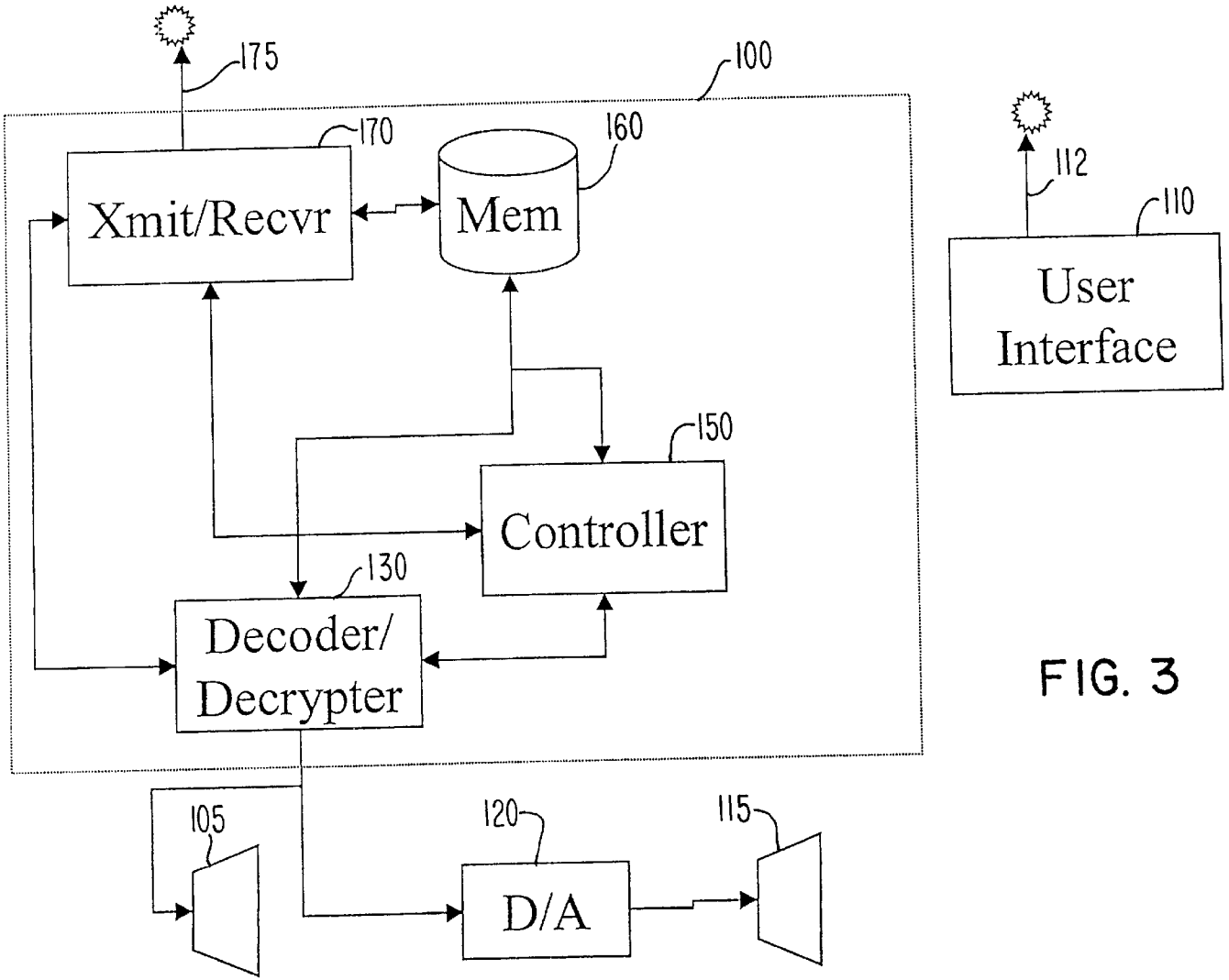
FIG. 3 illustrates vehicular audio data file handling apparatus and a wireless user interface according to the invention.

FIG. 3 illustrates a first example of vehicular audio data file handling apparatus according to the invention. As shown in FIG. 3, the inventive vehicular audio data file handling apparatus 100 includes a transmitter/receiver 170 connected to a memory 160, controller 150, and decoder/decryptor 130. The memory 160 is also connected to the controller 150 as well as the decoder/decryptor 130. Furthermore, the decoder/decryptor 130 is connected to the controller 150 as well as sound reproduction devices (digital speaker 105 and the combination of a D/A (digital to analog) converter 120 which is connected to an analog speaker 115). Of course, there may be a collection of speakers to provide a stereo sound system.

As further shown in FIG. 3, a user interface 110 may also be provided. The user interface 110 of FIG. 3 may be a wireless user interface connected to an antenna 112. The wireless signals from user interface 110 are transmitted via antennas 112, 175, and transmit/receiver 170 to controller 150. The controller 150 receives the commands from the user interface 110 and exercises control over the other components as desired. The user interface 110 may send a variety of conventional commands such as play, stop, skip, fast forward, rewind, etc.

The user interface 110 may also send a wireless triggering signal either directly to the base station 80 via antennas 112 and 75 to transmitter/receiver 70 of base station 80. Alternatively, the triggering command may be sent in a relay fashion, first to the vehicular audio data file handling apparatus 100 via antennas 112 and 175 and then to the base station 80 via antennas 175, 75. More particularly, a triggering command can be sent by user interface 110 via antenna 112, antenna 175, transmitter/receiver 170, and thereby to controller 150. This command signal can then be repeated or otherwise relayed to the base station 80 via antennas 175, 75. If properly configured, the transmitter/receiver 170 can handle this repeat or relay function without involving the controller 150.

The triggering command sent from the user interface 110 to the base station 80 triggers the base station 80 to upload at least one audio data file to the vehicular audio data file handling apparatus 100. In this way, a user can upload one or more audio data files merely by pressing a button on a wireless user interface 110 which triggers the base station 80 to upload one or more audio data files to the vehicular audio data file handling apparatus 100. This uploading process may also include a batch of accumulated audio data files that are accumulated in the memory 60. In this way, the user can upload a batch or collection of accumulated audio data files.

To play back an audio data file, the user can enter an appropriate command on the user interface 110 which is sent to the controller 150 via antenna 112, antenna 175 and transmitter/receiver 170. The controller 150 receives this command and controls the memory 160 and decoder/decryptor 130 to decode and/or decrypt the audio data file stored in the memory 160 and supply the decoded and/or decrypted audio data file to the sound reproduction components (105,120,115). The decoder/decryptor 130 can perform either decoding, decryption, or both. Any conventional or to-be-invented audio data file format can be handled by decoder/decryptor 130. For example, MP3, WMA, RealAudio or other audio data file formats can be decoded and/or decrypted by decoder/decryptor 130.

The sound reproduction components include a digital speaker 105 and/or the D/A converter 120 and analog speaker 115. The sound reproduction components receive the decoded and/or decrypted audio data file and generate sound in the conventional manner.

Figure 4:
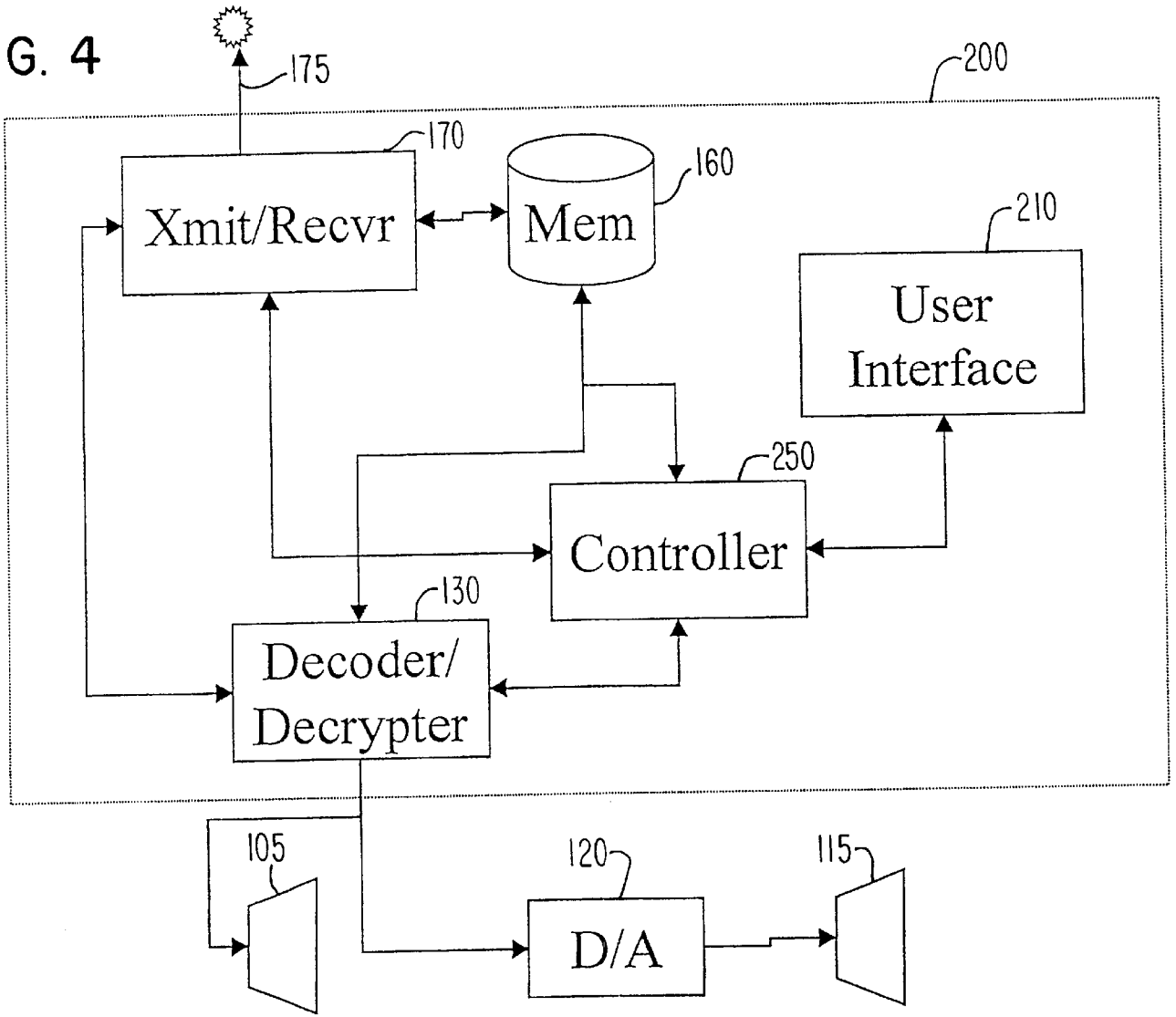
FIG. 4 is a diagram illustrating a vehicular audio data file handling apparatus according to the invention in which a user interface is integrated with the apparatus.

FIG. 4 illustrates an alternative construction for a vehicular audio data file handling apparatus 200 according to the invention. The main difference with respect to vehicular audio data file handling apparatus 100 is the placement and operation of FIG. 3's user interface 110. The FIG. 4 embodiment locates the user interface 210 together with the vehicular audio data file handling apparatus 200. For example, the user interface 210 may be a front control panel having one or more buttons, switches or other control inputs such as voice. The user interface 210 generally operates like the user interface 110 except that the commands are sent to the controller 250 directly instead of through a wireless interface. For example, the triggering command can be entered on the user interface 210 and sent to the base station 80 by the controller 250 and transmit/receiver 170 and antennas 175, 75. The other, conventional commands mentioned above can also be entered by accessing the user interface 210.

Figure 5:
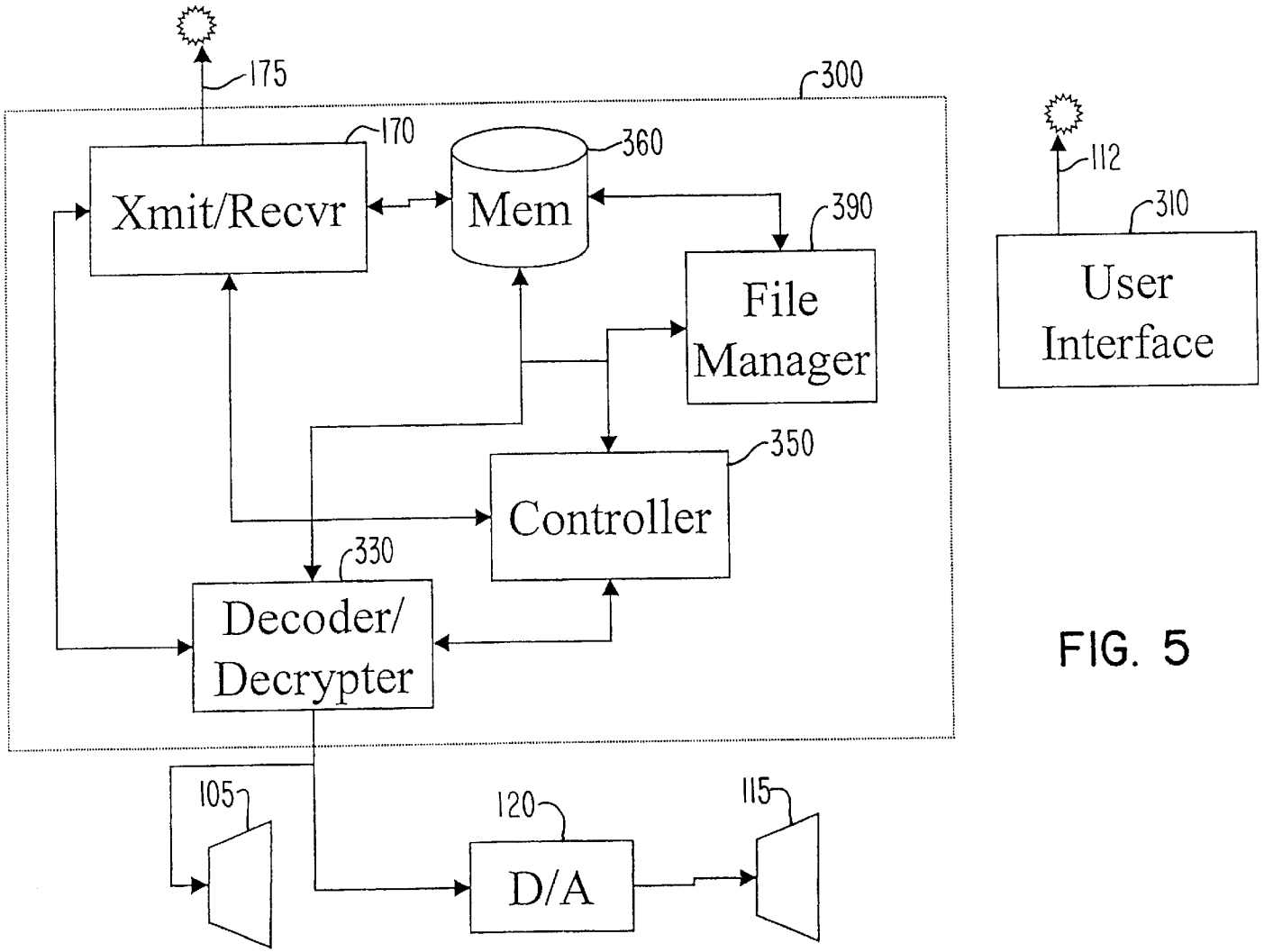
FIG. 5 is a diagram illustrating a vehicular audio data file handling apparatus according to the invention including a wireless user interface and file manager.

FIG. 5 illustrates another alternative for a vehicular audio data file handling apparatus 300. In this alternative, a file manager 390 is added. File manager 390 manages the audio data files stored in the memory device 360. Such file managing includes organization, deletion, editing, etc. of one or more audio data files stored in memory 360. Because file-managing functions are now available, the user interface 310 may also include file managing control buttons or inputs. The main difference for the decoder/decryptor 330 with respect to the decoder/decryptor 130 of FIG. 4 and FIG. 3 is that the decoder/decryptor 330 has an additional connection to the file manager 390. Likewise, the controller 350 also has a connection to the file manager 390 to permit appropriate control thereof.

Figure 6:
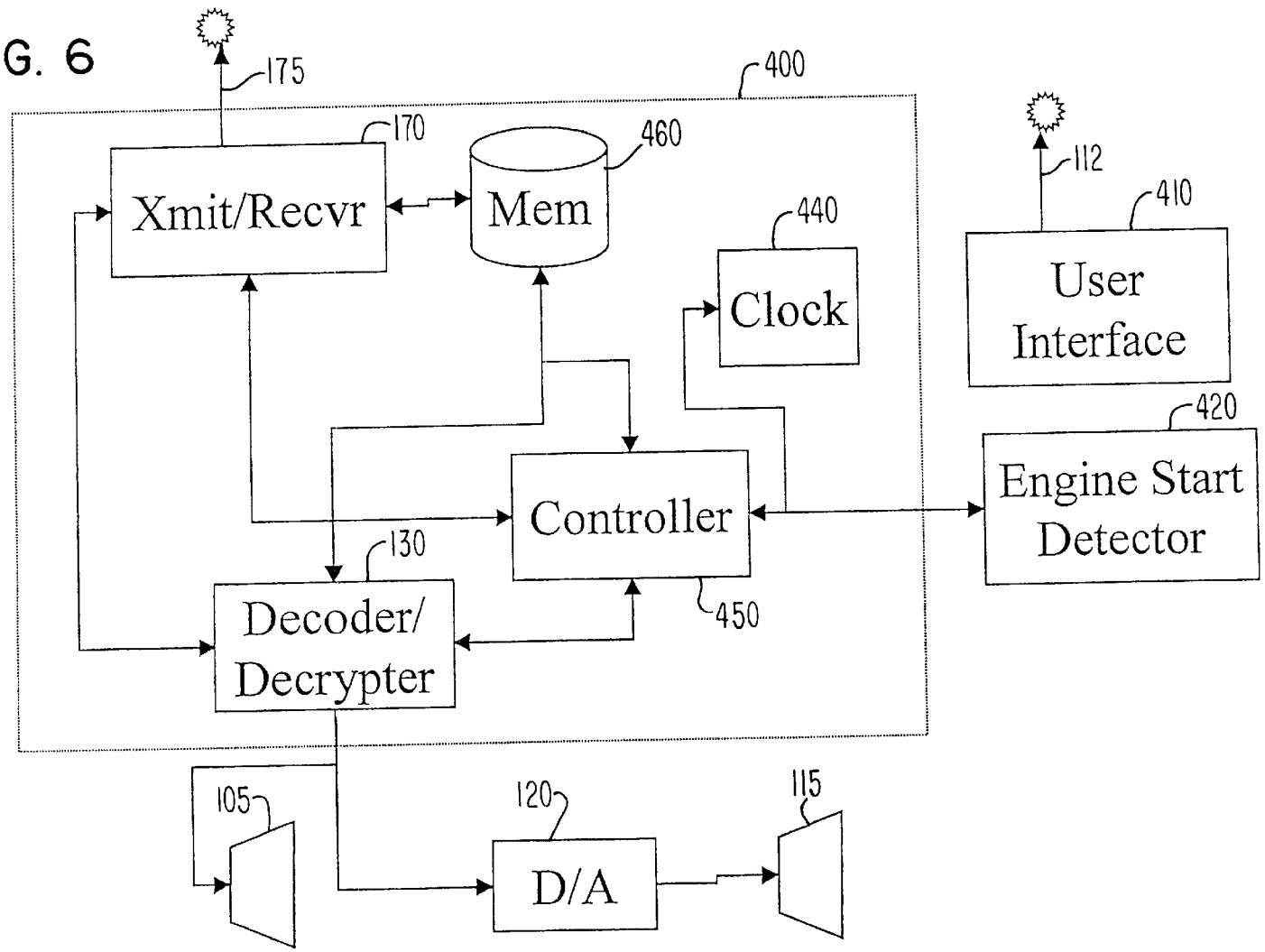
FIG. 6 is another vehicular audio data file handling apparatus according to the invention including a wireless user interface, engine start detector, and timekeeping device.

FIG. 6 illustrates another alternative for a vehicular audio data file handling apparatus 400. One difference is the addition of engine start detector 420. The engine start detector 420 detects a vehicle start condition. For example, the engine start detector 420 may be connected to the ignition switch or other component of the vehicle involved in starting of the vehicle. If the vehicle is an electric vehicle, then engine start should be interpreted to mean turning the electric vehicle on. The vehicle start condition may also include merely inserting a key in the ignition or turning the ignition switch to an on or accessory position.

The FIG. 6 embodiment also includes a clock 440 connected to the controller 450. The clock 440 keeps track of the present time. Furthermore, the controller 450 and memory 460 may store a designated time. The operation of the FIG. 6 embodiment is further described in relation to the flow charts of FIGS. 8 and 9 which are discussed in detail below.

Figure 7:
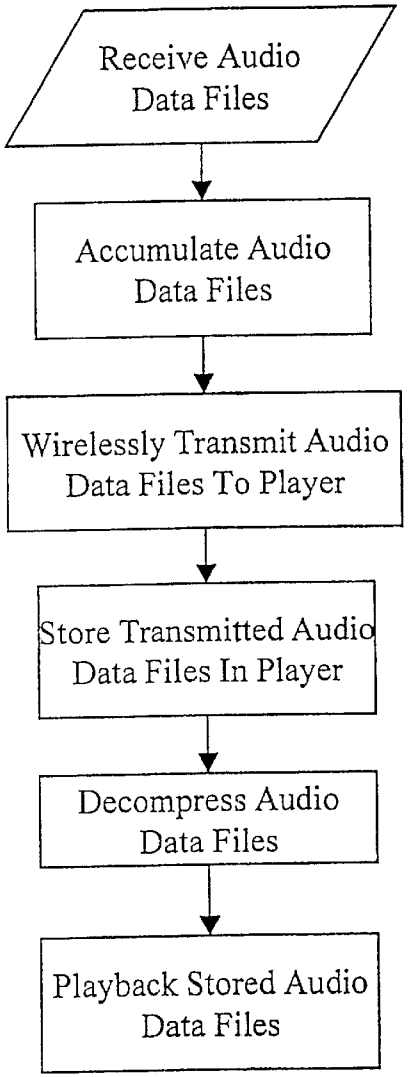
FIG. 7 is a high-level flow chart illustrating a method of transferring audio data files according to the invention.

FIG. 7 illustrates an exemplary method of operating the inventive system. The process starts by receiving audio data files. This may be done by routing content from the content server 10 through one or more of the communication paths (20, 22, 24, 30, 32) to a base station (80 or 85). The base station (80 or 85) accumulates the audio data files in the memory 60.

The base station (80 or 85) can then wirelessly transmit the accumulated audio data files to a player such as the vehicular audio data file handling apparatus (100, 200, 300, or 400). As described above, this wireless transmission may be triggered by the user interface (110, 210, 310 or 410). In the wireless embodiments, the wireless user interface 110, 310, or 410 wirelessly transmits a triggering signal either directly to the base station (80 or 85) via the associated antennas or by a relay. The signal relay is from the user interface (110, 310 or 410) to the apparatus (100, 300 or 400) and then to the base station (80 or 85).

Alternatively, the triggering signal may be entered on a non-wireless user interface 210 and sent by the apparatus 200 to the base station (80 or 85). In any event, such a triggering signal causes the base station (80 or 85) to wirelessly transmit audio data files to a player such as the vehicular audio data file handling apparatus (100, 200, 300 or 400).

In all of the embodiments, the wireless transmission of audio data files may be performed in a continuous or discrete manner. The discrete transmission may be initiated by the triggering signal mentioned above and would then occur in a discrete fashion. A continuous transmission may also occur when the apparatus 200 is within transmission range.

The vehicular audio file handling apparatus (100, 200, 300 or 400) then stores the transmitted audio data files in the memory (160, 260, 360, or 460, respectively). The user may enter a command or the playback may start automatically. Playing the audio data files is accomplished by feeding the audio data files from the memory (160, 260, 360 or 460) to the decoder/decryptor (130 or 330) for appropriate decoding and/or decrypting and then to the sound reproduction devices (105, or 120/115).

Figure 8:
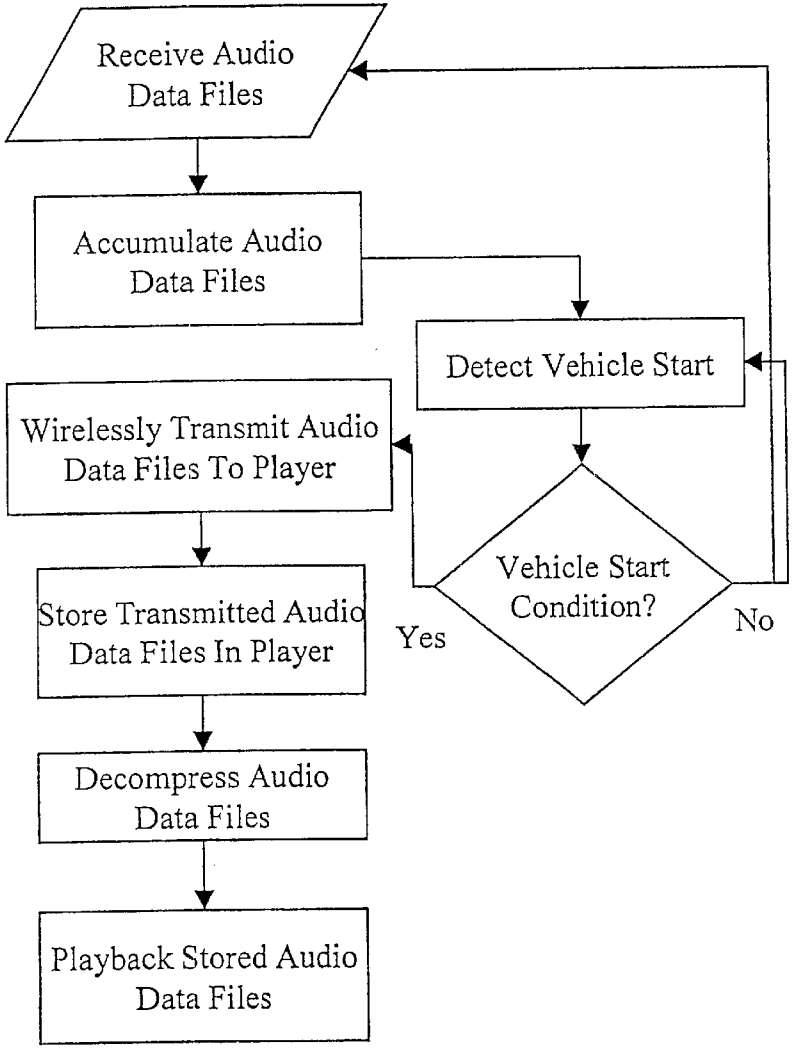
FIG. 8 is a high-level flow chart illustrating another audio data file transferring method in which a vehicle start condition serves as a trigger for the wireless audio data file transfer.

FIG. 8 illustrates an alternative method for transferring audio data files from a base station (80 or 85) to a vehicular audio data file handling apparatus 400. Preferably, the method of FIG. 8 operates with the system shown in FIG. 6 which includes an engine start detector 420. The main difference between the method of FIG. 8 and method of FIG. 7 is the addition of a step which detects the vehicle start condition. This may be done by the engine start detector 420 which sends a signal to the controller 450 upon detecting a vehicle start condition.

The method then determines whether the vehicle start condition has been detected. If not, the method loops back either to the detect vehicle start step or back to the receive audio data file step which is described above. If the vehicle start condition is detected, then the system wirelessly transmits at least one audio data file from the base station (80 or 85) to the vehicular audio data file handling apparatus 400.

The remainder of the method of storing, decompressing and playing back the audio data files is essentially the same as the process shown in FIG. 7.

Figure 9:
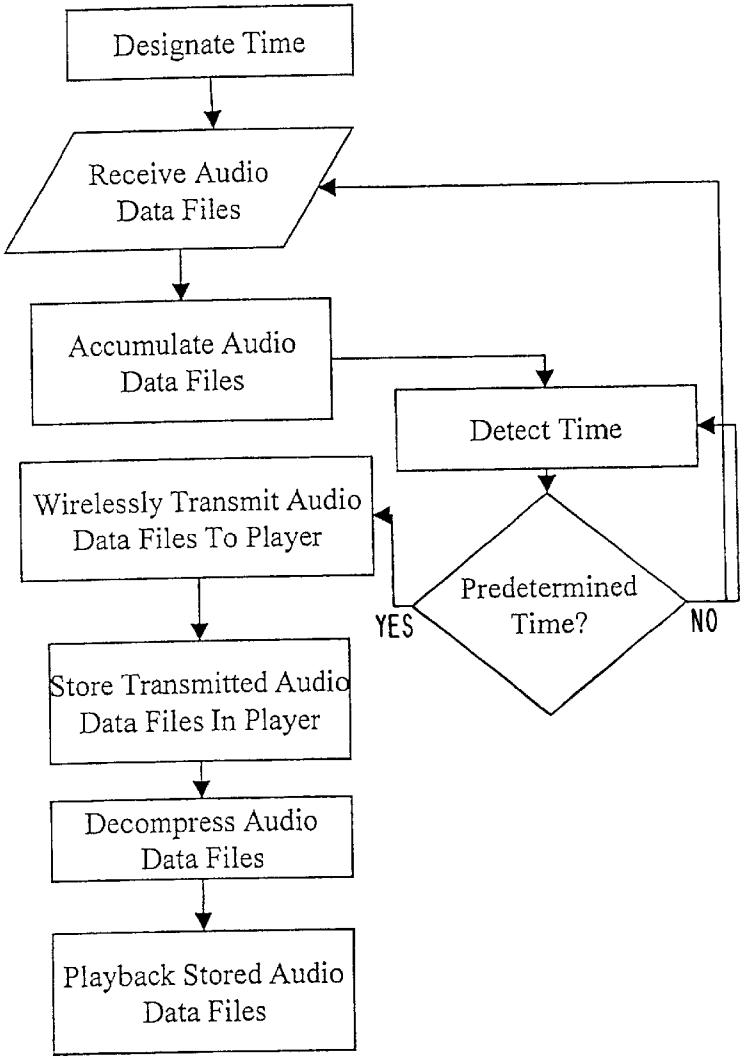
FIG. 9 is yet another high-level flow chart illustrating an inventive method of transferring audio data files at a predetermined time.

FIG. 9 shows another alternative method of transferring audio data files from a base station to a vehicular audio data file handling apparatus. This method may operate with the vehicular audio data file handling apparatus 400 shown in FIG. 6 which includes a clock 440. The FIG. 9 method has many similarities to the method shown in FIG. 7. The main difference is the addition of the time designation, detection, and determination steps. First, a time is designated or predetermined either by the factory or by the user. Then, after accumulating at least one audio data file, the method then detects the current time. This may be done by utilizing a time keeping device such as clock 440 shown in FIG. 6.

The method then determines whether the current time or detected time is substantially the same as a predetermined time. As mentioned above, this predetermined time may be a factory setting predetermined by the factory or it can be set by the user via the user interface 410. If the predetermined time has not arrived, the method loops back to either the detect time step or the receive audio data file step.

If the predetermined time has arrived, on the other hand, this triggers the base station (80 or 85) to wirelessly transmit at least one audio data file to a player such as the vehicular audio data file handling apparatus 400. In this way, the arrival of a predetermined time automatically triggers the system to wirelessly transmit audio data files from a base station to a player.

In this way, a user can conveniently upload audio data files to a vehicular audio data file handling apparatus. For example, the designated time may be 3:00am at which time the vehicle is most likely sitting in a garage close to the base station. Thus, while the consumer sleeps, the accumulated audio data files are automatically transferred from the base station (80 or 85) to the vehicular audio data file handling apparatus 400.

The wireless transmissions utilized by this invention include a wide variety of protocols and frequencies. For example, the wireless transmissions executed by transmit/receiver (70 and 170), user interface (110, 310 or 410) as well as the antennas 175 and transmit/receivers 170 may utilize radio frequency (RF), infrared (IR), or any other electromagnetic radiation frequency. Furthermore, the communications may also utilize spread spectrum protocols or, indeed, any other conventional or to-be-invented wireless communication protocol or technology.

Furthermore, the wireless transmission between the base station (80 or 85) and the audio data file handling apparatus (100, 200, 300 or 400) may utilize cellular or other wireless networks in order to achieve long distance communications. In this way, the triggering signal from the audio data file handling apparatus (100, 200, 300 or 400) may be sent over a long distance to a base station (80 or 85). Similarly, the base station may upload one or more audio data files to the audio data file handling apparatus (100, 200, 300 or 400) over a long distance utilizing cellular or other wireless networks.

Furthermore, the audio data file-handling apparatus disclosed herein is not limited to vehicular applications. In other words, the audio file handling apparatus may simply be a portable device that can be carried or otherwise moved by a user from place-to-place.

The invention being thus described, it will be obvious that the same may be varied in many ways. Such variations are not to be regarded as departure from the spirit and scope of the invention, and all such modifications as would be obvious to one skilled in the art are intended to be included within the scope of the following claims.

What is claimed is:

1. An audio data file handling apparatus, comprising:

a wireless receiving unit, said wireless receiving unit receiving at least one audio data file;

a memory operatively connected to said wireless receiving unit;

a controller operatively connected to said wireless receiving unit and said memory; and a condition detector operatively connected to said controller;

said controller monitoring said condition detector such that when said condition detector detects satisfaction of the condition, said controller triggers a base station to upload at least one audio data file to said wireless receiving unit, said controller storing the audio data file received from the base station via said wireless receiving unit in said memory, said condition detector detecting a start condition of a vehicle in which the audio data file handling apparatus is located.

2. A method of transferring audio data files to an audio data file handling apparatus, comprising:

receiving a plurality of compressed audio data files;

accumulating the compressed audio data files in a storage device;

utilizing a mobile phone to wirelessly transmit at least a portion of the accumulated, compressed audio data files to the audio data file handling apparatus;

storing the compressed audio data files received by the audio data file handling apparatus in a memory;

decompressing at least one of the stored audio data files upon a command from a user; and sending the decompressed audio data file to a sound reproduction device.

3. A method of transferring audio data files to an audio data file handling apparatus, comprising:

receiving a plurality of compressed audio data files;

accumulating the compressed audio data files in a storage device;

wirelessly transmitting at least a portion of the accumulated, compressed audio data files to the audio data file handling apparatus;

storing the compressed audio data files received by the audio data file handling apparatus in a memory;

decompressing at least one of the stored audio data files upon a command from a user;

sending the decompressed audio data file to a sound reproduction device; and detecting a start condition of a vehicle in which the audio data file handling apparatus is located;

said wireless transmitting step transmitting at least a portion of the accumulated, compressed audio data files to the audio data file handling apparatus when said detecting step detects the start condition.

* * * * *